US006685331B1

(12) United States Patent
Rockwell

(10) Patent No.: US 6,685,331 B1
(45) Date of Patent: Feb. 3, 2004

(54) CHEMILUMINESCENT DEVICE

(76) Inventor: Edward T. Rockwell, 1427 Main St., Leominster, MA (US) 01453

( * ) Notice: Subject to any disclaimer, the term of this patent is extended or adjusted under 35 U.S.C. 154(b) by 0 days.

(21) Appl. No.: 09/438,830

(22) Filed: Nov. 12, 1999

(51) Int. Cl.[7] ..... F21K 2/06

(52) U.S. Cl. ..... 362/34; 362/154; 220/506; 220/528

(58) Field of Search ..... 362/34, 154; 43/17.6, 43/17.5; 220/506, 526, 528

(56) References Cited

U.S. PATENT DOCUMENTS

| | | | | | |
|---|---|---|---|---|---|
| 2,256,240 | A | * | 9/1941 | Clemons | 119/14.02 |
| 3,470,929 | A | * | 10/1969 | Thorton | 215/378 |
| 3,576,987 | A | | 5/1971 | Voight et al. | 240/2.25 |
| 3,764,796 | A | | 10/1973 | Gilliam et al. | 240/2.25 |
| 3,813,534 | A | * | 5/1974 | Gilliam | 362/34 |
| 3,819,925 | A | * | 6/1974 | Richter et al. | 206/219 |
| 4,064,428 | A | * | 12/1977 | Zandt | 362/34 |
| 4,584,848 | A | * | 4/1986 | Barnett | 220/506 |
| 4,874,107 | A | * | 10/1989 | Arnau-Munoz et al. | 220/23.87 |
| 4,972,300 | A | * | 11/1990 | Beisswanger et al. | 362/34 |
| 5,121,302 | A | | 6/1992 | Bay et al. | 362/34 |
| 5,467,877 | A | * | 11/1995 | Smith | 215/11.1 |
| RE35,132 | E | | 12/1995 | Bay et al. | 362/34 |
| 5,488,544 | A | | 1/1996 | Ladyjensky | 362/34 |
| 5,525,299 | A | | 6/1996 | Lowe | 422/99 |
| 5,733,030 | A | * | 3/1998 | Cohn et al. | 362/34 |
| 5,913,616 | A | * | 6/1999 | Galella | 40/542 |
| 5,938,313 | A | * | 8/1999 | Fujita | 362/34 |
| 6,082,866 | A | * | 7/2000 | Amedee | 362/34 |

FOREIGN PATENT DOCUMENTS

| | | | | |
|---|---|---|---|---|
| EP | 0-136-564 | * | 8/1984 | 313/625 |

* cited by examiner

*Primary Examiner*—Sandra O'Shea
*Assistant Examiner*—Ismael Negron
(74) *Attorney, Agent, or Firm*—David N. Caracappa

(57) ABSTRACT

A chemiluminescent device includes an outer container, having an interior surface defining an interior space, and an insert, placed in the interior space, and separated from the interior surface

19 Claims, 2 Drawing Sheets

CHEMILUMINESCENT DEVICE

FIELD OF THE INVENTION

Figure 1:
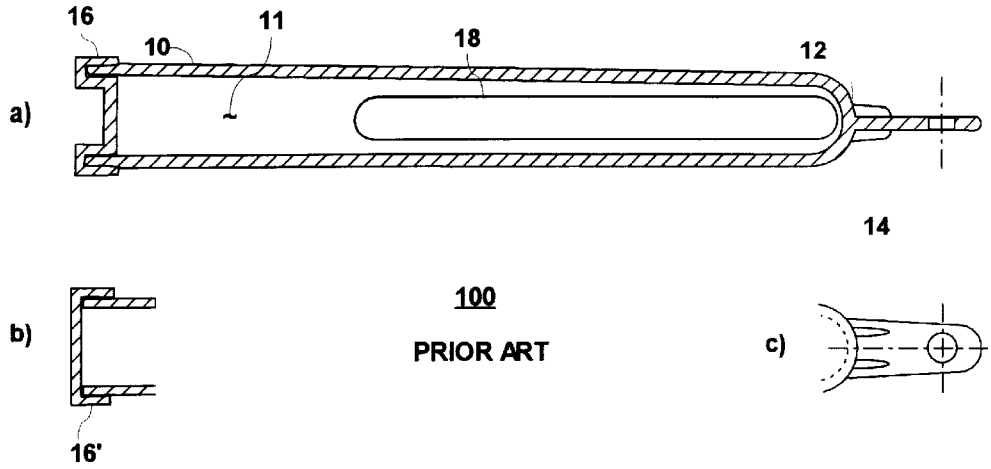

The present invention relates to a chemiluminescent device which, for a given lighted surface area, requires less chemicals without substantially decreasing the light output.

BACKGROUND OF THE INVENTION

Chemiluminescent devices are well known. They operate in a known manner through the mixture of a first and a second known chemical. When these two chemicals mix, the resulting liquid emits light, i.e. luminesces.

FIG. 1*a* is a sectioned view of the construction of a prior art chemiluminescent device in the form of what is known as a light stick 100. The light stick 100 illustrated in FIG. 1*a* is shown in a sectioned view. In FIG. 1*a*, a longitudinal axis is defined along the elongated dimension of the light stick, i.e. a horizontally in FIG. 1*a*. A transverse dimension is defined perpendicular to the longitudinal axis, i.e. into and out of the figure. The light stick 100 has a circular transverse cross-section. One skilled in the art will understand, however, that any transverse cross-sectional shape may be used. The light stick 100 consists of an outer container 10 which is closed at the right hand side 12 of FIG. 1*a*. Also at the right hand side 12 of the light stick 100 is a mounting flange 14. The front view of the mounting flange 14 is shown in FIG. 1*c*, and includes a mounting hole and stiffeners. The outer container 10 is open at the left hand side of FIG. 1*a*. A cap 16 is attached to the open end of the outer container 10 sealing the outer container. The interior surface of the outer container 10, when it is sealed by the cap 16, defines an interior space 11. An inner container 18 is placed within the interior space 11.

The inner container 18 is formed of a relatively brittle material, preferably glass. The outer container 10 is transparent or translucent, to maximize light transmission; and is fabricated from a material which is relatively flexible. The outer container is preferably LDPE plastic having a thickness of around 0.065 inches which may be formed using injection molding. The cap 16 is fabricated of a material which may be easily attached to the outer container 10. The cap may also be formed using injection molding and in the preferred embodiment is also LDPE plastic.

The inner container 18 is initially an open glass tube with one closed end. It is filled with the first chemical, then the other end is sealed by heating the open end of the tube, melting the glass until that end is sealed. The filled and sealed inner container 18 is placed inside the outer container 10. The outer container 10 is then filled with the second chemical and the cap 16 attached to the open end, all in a known manner.

The cap 16 may be sealed to the outer container 10 by any of a variety of known means, such as heat staking or sonic welding. In a preferred embodiment, the cap 16 is friction welded to the open end of the outer container 10 by being spun rapidly on the outer container until friction raises the temperature of the plastic at the mating surfaces of the outer container 10 and the cap 16 to, or just past, the melting point. Plastic from the cap and outer container fuse forming a sealed joint. The joint is then cooled and a welded seal is formed, all in a known manner. In FIG. 1*a*, the cap 16 is formed with a recess for the outer container 10 so that there are mating surfaces between the cap and both the outside and the inside surfaces of the outer container 10. This arrangement stabilizes the cap 16 on the opening, and enables the cap to remain centered while being sealed to the outer container 10.

FIG. 1*b* shows an alternative cap 16'. The cap 16' has a simple shape and has a mating surface only for the outside surface of the outer container 10. The cap 16' may be fabricated of the same material as cap 16 (FIG. 1*a*) and attached to the outer container 10 in the same manner. Cap 16' has about one-half the sealing area, and, thus, may be more prone to faulty sealing and consequent leakage and failure than the cap 16 illustrated in FIG. 1*a*.

In operation, the user flexes the light stick 100, breaking the inner container 18. The first chemical in the inner container 18 mixes with the second chemical in the interior space within the outer container 10, and the resulting liquid begins to luminesce.

One problem with such luminescent devices is that the chemicals are relatively expensive. Thus, a light stick of a given lighted surface area which can produce substantially the same intensity of light, but use less chemicals is desirable. Another problem occurs in the application of such light sticks in commercial fishing. In this environment, the light sticks are subject to great external pressure from water depths of a mile or more. Light sticks used in this environment sometimes fail. It is believed that it is the presence of air within the outer container which causes this failure. While the liquid in the light stick is incompressible, the air is compressible. If enough air is trapped within the light stick, it will compress and the light stick will deform, sometimes to the point of rupturing it. Thus, a light stick in which the amount of air trapped can be minimized is believed to be desirable.

BRIEF SUMMARY OF THE INVENTION

The inventor realized that light is emitted only from the outer surface of the outer container 10. The luminescing liquid in the transverse middle of the outer container contributes relatively little to the light output of the light stick 100, compared to the liquid close to the outer surface. In accordance with principles of the present invention, a chemiluminescent device, includes an outer container, having an interior surface defining an interior space, and an insert, placed in the interior space, and separated from the interior surface of the outer container 10.

The insert takes up some of the interior space, which, thus, requires less chemical to fill. However, the insert is separated from the interior surface of the outer container 10. For example, it is placed in the transverse middle of the interior space. Consequently, luminescing chemical is displaced only from the middle of the interior space, which liquid would have contributed relatively little to the light intensity output from the light stick, as described above. The luminescing chemical is still in contact with the same surface area of the outer container 10, and the light intensity, thus, is not significantly decreased. Furthermore, for the same reason that less chemical is required to fill the light stick, less air will tend to be trapped in the light stick decreasing the chance of deformation and failure in a high pressure environment.

Figure 2:
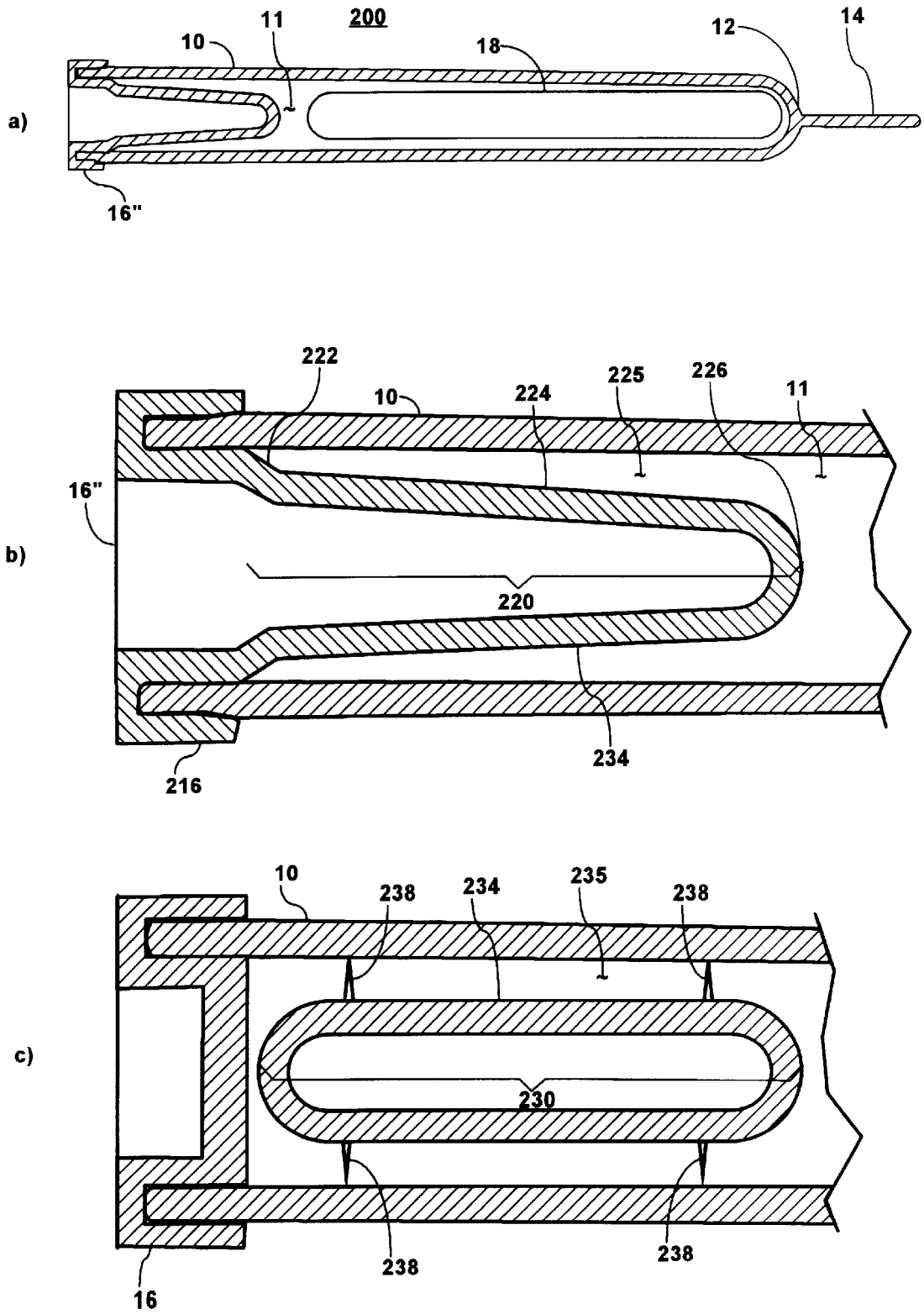

In the drawing:

FIG. 1 is a cross-sectional view of the construction of a prior art chemiluminescent device; and FIG. 2 is a cross-sectional view of the construction of an embodiment of a chemiluminescent device according to principles of the present invention.

FIG. 2 is a cross-sectional view of the construction of an embodiment of a chemiluminescebt device according to principles of the present invention. In FIG. 2, those elements which are the same as those illustrated in FIG. 1 are designated using the same reference number and are not described in detail below. FIG. 2*a* corresponds to FIG. 1*a*, and FIGS. 2*b* and 2*c* are more detailed cross-section views of a portion of the light stick 100 illustrated in FIG. 2*a*.

In FIG. 2*a*, it can be seen that an insert is placed into the interior space 11 of the outer container 10. In FIG. 2*b*, the insert 220 is an integral part of the end cap 216, which is roughly the same shape as the end cap 16 illustrated in FIG. 1 (i.e. having two surfaces contacting the inner and outer surface of the outer container 10 for better sealing, stability and centering). In a preferred embodiment, the insert has the same transverse cross-section as that of the outer container 10. That is, in the illustrated embodiment, the transverse cross-section of both the outer container 10 and the insert is circular. The insert reduces the volume of the interior space 11, thus, reducing the amount of chemical needed to fill the interior space 11 and air trapped in the interior space. Further, the insert is separated from the wall of the outer container 10, allowing the is chemical in the interior space 11 to contact the wall of the outer container 10 in the interstitial space between the insert and the wall of the outer container 10. Consequently, when the chemical is luminescing, light will be emitted from the wall of the outer container 10 where the liquid is in contact with it.

Referring to FIG. 2*b*, it may be seen that the insert 220 is substantially conical. Thus, luminescing chemical is able to enter the interstitial area 225 between the insert 220 and the wall of the outer container 10. More specifically, the insert 220 illustrated in FIG. 2*b* is substantially a frustrum including a conical section 224 and an end section 226. Even more specifically, the insert 220 is a rounded frustrum. That is, the end 226 of the insert 220 is rounded off. In addition, at the base of the insert, a chamferred section 222 connects the cap section 216 to the conical section 224. The chamfer 222 increases the depth of the luminescing liquid near the end cap 216, and allows the luminescing liquid to descend to the end cap 216.

FIG. 2*c* illustrates an alternative embodiment of an insert 230. In FIG. 2*c*, the insert 230 is a distinct element. That is, the insert 230 is not a part of the cap 16 (which is identical to that illustrated in FIG. 1*a*.). In FIG. 2*c*, the insert 230 is shaped like a capsule, having the same transverse cross-section as that of the outer container 10. In the illustrated embodiment, the transverse cross-section is circular. In FIG. 2*c*, the insert 230 is maintained separated from the walls of the outer container 10 so that luminescing chemical is in contact with the walls of the outer container 10 in the interstitial area 235. In the embodiment illustrated-in FIG. 2*c*, spacers 238 maintain the space between the insert 230 and the wall of the outer container 10. The spacers 238 may be in the form of filaments placed between the insert 230 and the wall of the outer container. Or the spacers 238 may be loops of material. The spacers 235 may be made integral with the insert 230, or integral with the outer container 10, or may be distinct elements.

The luminescing chemical in the interstitial area 235 contacts the wall of the outer container 10 and produces light. As described above, because the liquid in the transverse middle of the interior space 11 within the outer container 10 contributes relatively little to the intensity of the light output from the surface of the light stick 100, the insert 230 does not substantially decrease the light output of the light stick 100.

The inserts 220 and 230 illustrated in FIGS. 2*b* and *c*, respectively, are preferably hollow, as illustrated, though they may also be solid, or filled with another material. In FIG. 2*b*, the insert 220 is fabricated from the same material as the cap 216, and thus is translucent or transparent. The insert 230 in FIG. 2*c* may also be fabricated from the same material. However, in such a case, the luminescing chemical also emits light from the surface of the insert 220 or 230 into the interior of the insert 220 or 230. This light is not emitted from the lightstick, and is wasted. Thus, the material from which the insert 220 or 230 is fabricated may advantageously be made highly reflective on its outside surface. For example, the outer surface of the insert 220 or 230 may be mirrored or colored opaque white. This will reflect the light incident on the surface of the insert 220 or 230 back out toward the wall of the outer container 10, thus, increasing the light intensity output of the light stick 100.

The inserts illustrated in FIG. 2 displace liquid from the transverse middle of the outer container, thus, requiring less chemical to fill the light stick. The light output of the light stick, however, is not substantially decreased because the inserts are separated from the wall of the outer container. For the same reason that less chemical is needed to fill the light stick containing an insert, less air is likely to be trapped in such a light stick, which is assumed to minimize the possibility of failure of the light stick in a high pressure environment.

What is claimed is:

1. A chemiluminescent device, comprising:

an outer container, having an interior surface defining an interior space;

an insert, placed in the interior space, and separated from the interior surface of the outer container; and an inner container, placed in the interior space, and containing a first reactant; wherein:

the outer container is substantially filled by the inner container, a second reactant and the insert.

2. The chemiluminescent device of claim 1 wherein the insert has an outer surface conditioned to be highly reflective.

3. The chemiluminescent device of claim 2 wherein the outer surface of the insert is mirrored.

4. The chemiluminescent device of claim 2 wherein the outer surface of the insert is opaque white.

5. The chemiluminescent device of claim 1 wherein the outer container is substantially cylindrical.

6. The chemiluminescent device of claim 5 wherein the outer container is elongated along a longitudinal axis and has a transverse cross-section perpendicular to the longitudinal axis, and the insert has substantially the same transverse cross-section.

7. The chemiluminescent device of claim 5 wherein the outer container is elongated along a longitudinal axis and has substantially a circular transverse cross-section perpendicular to the longitudinal axis and the insert has substantially a circular transverse cross-section.

8. The chemiluminescent device of claim 1 wherein:

the outer container is elongated and has a first end defining an opening;

the chemiluminescent device further comprises a cap, configured to seal the opening; and the insert is attached to the cap.

9. The chemiluminescent device of claim 8 wherein the insert is integrally formed with the cap.

10. The chemiluminescent device of claim 8 wherein the insert is substantially conical.

11. The chemiluminescent device of claim 8 wherein the insert is substantially a frustrum.

12. The chemiluminescent device of claim 8 wherein the insert is substantially a rounded frustrum.

13. The chemiluminescent device of claim 8 wherein the insert comprises a substantially conical section, and a chamferred section between the conical section and the cap.

14. The chemiluminescent device of claim 13 wherein the conical section is substantially a frustrum.

15. The chemiluminescent device of claim 13 wherein the conical section is substantially a rounded frustrum.

16. The chemiluminescent device of claim 1 wherein the insert is distinct and maintained separated from the interior surface of the outer container by spacers placed between the interior surface of the outer container and the insert.

17. The chemiluminescent device of claim 16 wherein the outer container is elongated along a longitudinal axis and has a transverse cross-section perpendicular to the longitudinal axis, and the insert has the same transverse cross-section.

18. The chemiluminescent device of claim 17 wherein the outer container has a circular transverse cross-section, the insert has a circular transverse cross-section and is capsule-shaped.

19. A chemiluminescent device container kit, comprising component parts of:

an outer container, having an interior surface defining an interior space; and an insert, adapted to be placed in the interior space, and separated from the interior surface of the outer container; wherein:

when assembled, the outer container is adapted to be substantially filled by:

an inner container, containing a first reactant;

the insert; and a second reactant.

* * * * *